US006344716B1

(12) United States Patent
Gibboney, Jr.

(10) Patent No.: US 6,344,716 B1
(45) Date of Patent: Feb. 5, 2002

(54) CHRISTMAS LIGHT STRING

(75) Inventor: James W. Gibboney, Jr., Conyers, GA (US)

(73) Assignee: Ventur Research & Development Corporation, Suwanee, GA (US)

( * ) Notice: Subject to any disclaimer, the term of this patent is extended or adjusted under 35 U.S.C. 154(b) by 0 days.

(21) Appl. No.: 09/674,878

(22) PCT Filed: May 7, 1999

(86) PCT No.: PCT/US99/09984

§ 371 Date: Nov. 7, 2000

§ 102(e) Date: Nov. 7, 2000

(87) PCT Pub. No.: WO99/58899

PCT Pub. Date: Nov. 18, 1999

Related U.S. Application Data

(60) Provisional application No. 60/084,848, filed on May 8, 1998.

(51) Int. Cl.[7] ..... H05B 37/00

(52) U.S. Cl. ..... 315/185 S; 315/185 R; 315/192; 315/193; 362/800; 362/806

(58) Field of Search ..... 315/185 S, 185 R, 315/192, 186, 193; 362/122, 123, 227, 800, 806

(56) References Cited

U.S. PATENT DOCUMENTS 4,675,575 A * 6/1987 Smith et al. ..... 315/185 S
4,780,621 A * 10/1988 Bartleucci et al. ..... 315/192 X
4,855,880 A * 8/1989 Mancusi, Jr. ..... 362/123
4,870,547 A * 9/1989 Crucefix ..... 362/123

* cited by examiner

*Primary Examiner*—Haissa Philogene
(74) *Attorney, Agent, or Firm*—Michael A Mann; Nexsen Pruet Jacobs & Pollard LLC

(57) ABSTRACT

An electrical circuit for use with plural, low voltage loads such as a string of Christmas lights is disclosed comprising groups of lights placed electrically in a series circuit but the lights within each group are in parallel, preferably with a semiconductor device in parallel with each group to limit current and voltage in the group. By suitable choice of bulb, group size and number of groups, a light string can be fashioned that that uses about one third the power with much less heat production and without loss of brightness. The semiconductor device can consist essentially of diodes such as two silica diodes on either side of a Zener diode, or a custom bipolar device.

19 Claims, 2 Drawing Sheets

CHRISTMAS LIGHT STRING

PRIORITY CLAIM

This application claims the benefit of U.S. Provisional Application No. 60/084,848, filed May 8, 1998.

FIELD OF THE INVENTION

The present invention relates generally to providing electrical power to a plurality of low voltage electrical loads, and, in particular, to a string of Christmas lights.

BACKGROUND OF THE INVENTION

In FIG. 1, light set 10 is a standard string of lights that is currently in widespread use. Light string 10 is powered by inserting a standard plug 12 into a wall outlet (not shown). The lamps 14 in light set 10 are arranged in a series electrical circuit. This configuration is the least expensive circuit for a string of lights, that is, for a plurality of low-voltage, low-current, small-sized electrical loads. Depending on the number of lamps, say 50 in a typical string, each lamp may typically require 2.5 volt at 200 milliamps. in a series configuration, the set then requires 120 volts to light it.

There are larger sets of lights, using 100 and 150 lights in a string. However, these are typically composed of three strings of 50 lights each, each string arranged electrically in a parallel circuit with each other string and each lamp within a string in series electrically with each other lamp in that string.

Normally, in a series circuit, when one bulb burns out, the set will not light until that bulb is replaced. Each lamp in these longer circuits, however, is equipped with a shunt that continues to pass the electric current around the bulb in the event that bulb burns out. The shunt is an aluminum oxide wire that is wrapped around a filament standoff post. When the filament burns open and current cannot flow through it, there is suddenly no voltage drop across the set. Then the voltage across the lamp rises quickly to line level (120 volts), arcs across the insulated shunt and welds the shunt across and into the circuit of the bad lamp so that current once again begins to flow through the light set. Although the lights in the light string are once again lighted, each bulb carries slightly more voltage because of the low-load shunt in the burned out bulb.

In the event that the shunt fails to save the light string, which happens about 30% of the time—higher in older light sets—the light string will fail completely.

In fact, in most instances, the failure of the light string is not caused by a bulb burning out but by a failure between the bulb contacts and the contacts in the socket the bulb is received in. The contacts are typically a nickel copper alloy and the socket contacts are made of brass (a tin/copper alloy). The contact between these dissimilar alloys will react in a Galvanic manner, degrading their contacting surfaces and thus the quality of the electrical connection between contacts until current flow is stopped and the lights go out.

Thus when a bulb is missing or its contacts are degraded sufficiently, the string will fail to light. In a string of 150 lights, this is a tedious problem to remedy.

Arranging the lights in parallel is not the answer although the string would light if one light were defective or missing or its contacts were degraded. A standard Super Bright lamp consumes 200 milliamps of power, a set of 150 lamps would draw 30 amps of power at 120 VAC, or 3600 watts, far too much power, and also a fire hazard for use as a decoration for a Christmas tree.

Consumption of power is a significant problem not only with a hypothetical string of 150 parallel lights but also with light strings generally. A 150 lamp conventional string will consume 72 watts of power and there are typically between 400 to 600 lights used on a single tree.

The use of both parallel and series configured bulbs in one string of Christmas tree lights is not unknown. For example, Smith et al, in U.S. Pat. No. 4,675,575, describe a light-emitting diode (LED) assembly for lighting a tree. Their strings of LEDs can be used with AC or DC. However, LEDs do not require much power and do not produce much light compared to incandescent bulbs, regardless of how small the latter are, and therefore do not have the inherent limitations of more conventional Christmas tree lights.

Mancusi, Jr., in U.S. Pat. No. 4,855,880, teaches a different arrangement of lights on a light string for illuminating a Christmas tree. His string includes incandescent "seed" bulbs arranged electrically in series and in parallel in an artificial tree. Rectifying conventional AC with a selenium rectifier to power his lights, he combines in series up to twelve sets of forty lights each; each light in a set is in parallel.

Also, Crucefix discloses another light system configuration in U.S. Pat. No. 4,870,547, based on a collar that is placed around the trunk of the tree at its top and which is used to deploy the various parallel sets of series lights.

There remains a need for an effective, low-power electrical circuit for a Christmas light string, or indeed, for any set of plural low voltage loads.

SUMMARY OF THE INVENTION

According to its major aspects and briefly recited, the present invention is an electrical circuit for a plurality of low-voltage electrical loads such as a string of Christmas lights. The circuit comprises groups of lights arranged in an electrical series circuit, and each light within a group is arranged in parallel. Preferably, five lights comprise each group and there are thirty groups to form a string of 150 lights, matching the number of lights in presently-available light strings. By varying the lamp voltage and the number of groups, light strings could range in size from 50 to over 200, matching and exceeding current popular sizes. Parallel to each group is a series of semiconductors or bipolar devices forming a parallel group device that limits voltage and current in the event one or more of the lights in that group goes out.

The present circuit can be used with any AC plug but is preferably used with the DC plug described in commonly owned U.S. Pat. No. 5,777,868.

A major advantage of the present invention is reduced power consumption. By comparison, instead of the 72 watts of power used by conventional strings of 150 lights, the present string uses only 10.8 watts of power, when using the DC plug recited in the co-pending application.

Another major feature of the present invention is the ability to achieve the low current and voltage advantages of a series light string while not allowing the loss of one bulb to cause a failure in the entire string. In one embodiment, with a semiconductor series or bipolar device arranged parallel to each group, loss of all the bulbs in the same group would not cause the string to fail. This arrangement eliminates a major problem of having one bulb produce the failure of the entire string as with series groups while preventing the failure of a single bulb to create a current stress on remaining bulbs as in parallel groups. In a normal parallel light string connected in series with other parallel light strings, after one bulb burns out, the other bulbs in that parallel group are exposed to a greater current level which in turn creates failures in more bulbs, consequently, these failures create a greater current stress in the remaining bulbs in that parallel group until all bulbs fail at an exponential rate. Moreover, with each failure, the light string produces a higher level of heat which shortens lamp life and produces a fire hazard.

In contrast, the present invention eliminates this avalanche effect by providing a semiconductor series or bipolar device that regulates current so that the remaining lamps are not stressed by additional current.

Other features and their advantages will be apparent to those skilled in the electrical arts from a careful reading of the Detailed Description of Preferred Embodiments accompanied by the drawings.

DETAILED DESCRIPTION OF PREFERRED EMBODIMENTS

Figure 1:
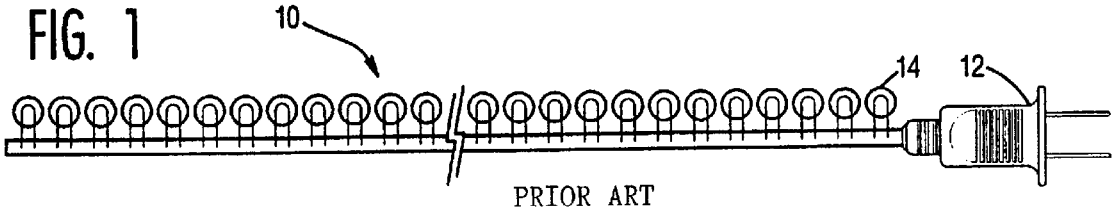
FIG. 1 is a schematic illustration of a conventional, prior art set of lights.
Figure 2:
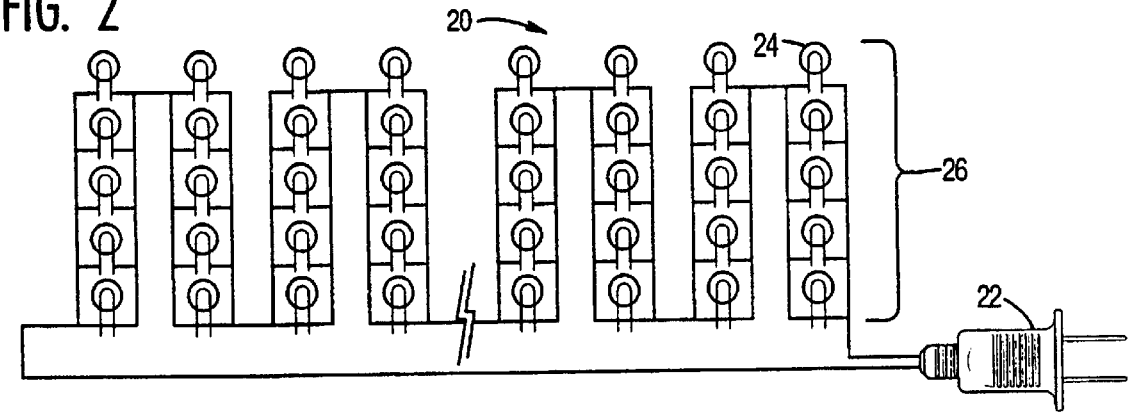
FIG. 2 is a schematic illustration of a string of lights according to a preferred embodiment of the present invention.

Referring now to FIG. 2, there is illustrated a light set 20 connected to a plug 22 and comprising a plurality of lamps 10.8 arranged in a combination series/parallel circuit. Using two volt, 40 milliamp lamps in a five lamp group 26 where each of the five lamps 24 is arranged electrically in a parallel circuit, a 150 lamp set can be configured from 30 such five-lamp groups that draws only 24 watts, rather than 72 as in light set 10 of FIG. 1 or 3500 watts as in a strictly parallel set described above. Each five-lamp group 26 draws 200 milliamps of current. If the present, preferred DC-output plug is used, this 150 lamp string requires 54 volts DC to light it.

However, if a lamp 24 fails, either due to degraded contacts, being missing, or burned out, the remaining lamps in that five-lamp group have to share the current among them. With one bulb out, each must now carry 50 milliamps rather than 40.

Eventually, a second bulb will burn out from carrying the higher current and then a third, each burning out in a more rapid progression until one entire five-lamp group 26 goes out. As soon as one five-lamp group fails, light set 20 will fail.

Figure 3:
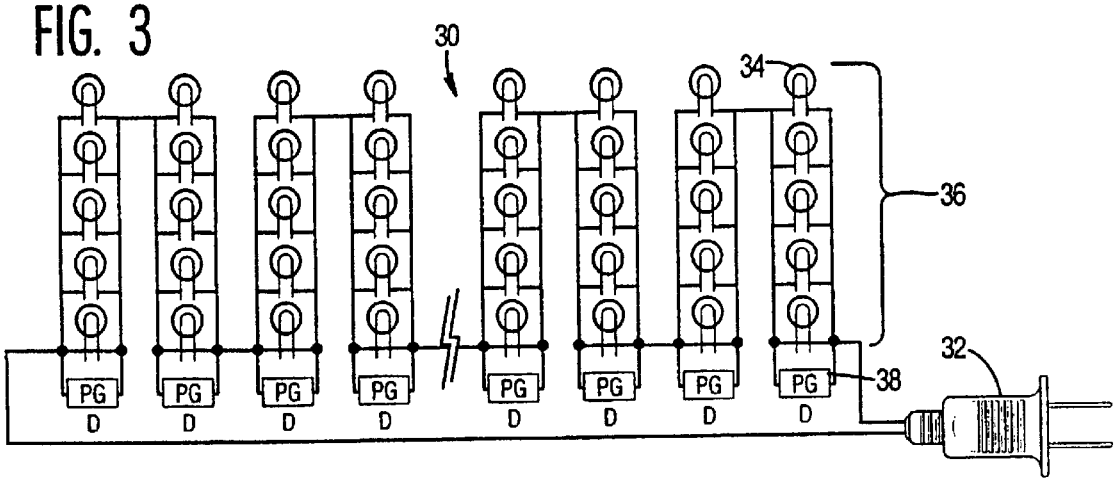
FIG. 3 is a schematic illustration of a string of lights according to an alternative preferred embodiment of the present invention.

Light Set 30, illustrated in FIG. 3, solves the problem of light set 20 and prior art set 10. In this set, which also has a plug 32 to which individual lamps 34 are connected in groups 36, a device 38 is added in parallel to the five-lamp group 36, which comprises five lamps in parallel to each other. This parallel group device 38 is composed of an integrated circuit comprised of multiple semiconductor junctions cascaded in a series fashion or of a bipolar device; the number of semiconductor junctions is determined by the lamp voltage. If a lamp 34 burns out, its contacts degrade or it is removed from the group 36, the voltage drop across the remainder of the group 36 changes slightly because of the increased current flow across the remaining lamps and the voltage drop due to the resistance of the wire itself.

By using PN junction semiconductors or custom bipolar devices, which have a voltage drop across them of a magnitude that depends on the design and material that the semiconductors are made of a device 38 can be constructed that is pre-programmed to regulate the current flowing through and voltage drop across group 38 so that it does not exceed a particular level and remains constant no matter what happens to an individual lamp 34.

Figure 4A:
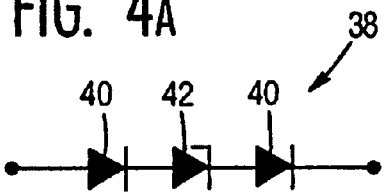
FIGS. 4A–4E are alternative embodiments of the parallel group device for use in an electrical circuit according to the alternative, preferred embodiment of the present invention.
Figure 4B:
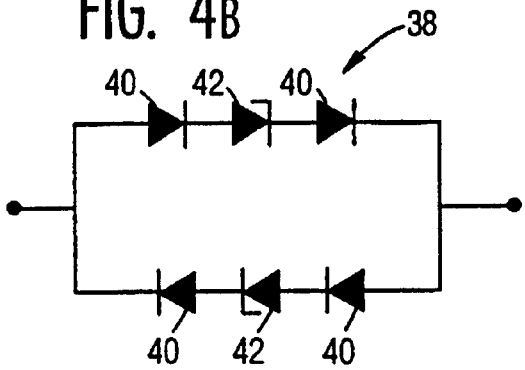
Figure 4C:
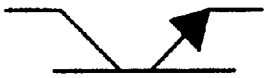
Figure 4D:
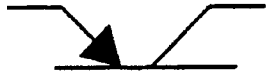
Figure 4E:
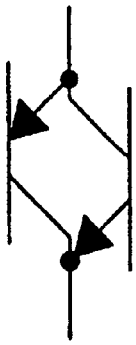

For use with a DC electrical plug, as described in co-pending application Ser. No. 08/847,345, this device 38 can comprise two silica diodes, each with a 1.1 volt forward voltage drop separated by a Zener diode with a 0.7 forward voltage drop, as illustrated in FIG. 4A, for a 2.9 volt total, nearly matching the three volt drop across the lights. For AC, six diodes, three in each direction, would be used, as shown in FIG. 4B. In another embodiment, a multi-junction, application-specific integrated circuit (ASIC) could be used that would functionally imitate the series of diodes. The integrated circuit could be a discrete component containing a PN-PN-PN-PN junction or a custom bipolar junction. It will be clear to those skilled in the art of integrated circuit fabrication that a multi-junction containing these specification could be made without undue experimentation.

The configuration of the parallel group device 38 assures that the voltage drop across the group 36 is always approximately three volts regardless of the number of bulbs missing, burned out, or whose contacts are degraded. If a bulb 34 is removed, for example, and the current rises, the reverse bias of the Zener diode is overcome. When it breaks down, it begins to conduct, thus in effect replacing the missing bulb. Preferably, the Zener diode does not have a sharp threshold for breaking down and can be selected to somewhat gradually begin passing current. Likewise, a custom bipolar device could be fashioned to produce like results.

It will be apparent to those skilled in the electrical arts that many modifications and substitutions can be made to the foregoing preferred embodiments without departing from the spirit and scope of the present invention, which is defined by the appended claims.

What is claimed is:

1. An electrical circuit for use as a string of lights, said circuit comprising:

plural groups of electrical loads, each group of said plural groups arranged electrically in series with each other group of said plural groups, each load within said each group arranged electrically in parallel with each other load within said group; and limiting means electrically connected to said each group of said plural groups for maintaining an approximately constant electrical current through each group of said plural groups in the event a load from a group of said plural groups is dropped.

2. The electrical circuit as recited in claim 1, wherein said limiting means maintains an approximately constant voltage across each group of said plural groups in the event an individual load from a group of said plural groups is dropped.

3. The electrical circuit as recited in claim 1, wherein said limiting means comprises a plural sets of semiconductors arranged parallel to said each group of said plural groups of electrical loads, said sets of semiconductors programmed to limit current and voltage in said groups in the event an individual load from said group is dropped.

4. The electrical circuit as recited in claim 1, wherein said limiting means comprises a first diode, a second diode and a Zener diode, said first, second and Zener diodes each having an anode and cathode, said anode of said Zener diode being connected electrically in series with said cathode of said first diode, said cathode of said Zener diode being connected electrically in series with said anode of said second diode.

5. The electrical circuit as recited in claim 1, wherein said limiting means comprises a first diode, a second diode, third diode, a fourth diode, a first Zener diode and a second Zener diode, said first, second, third, fourth, first Zener and second Zener each having an anode and cathode, said anode of said first Zener diode being connected electrically in series with said cathode of said first diode, said cathode of said first Zener diode being connected electrically in series with said anode of said second diode, said anode of said second Zener diode being connected electrically in series with said cathode of said third diode, said cathode of said second Zener diode being connected electrically in series with said anode of said fourth diode, said cathode of said fourth diode being connected electrically to said anode of said first diode, said cathode of said second diode electrically connected to said anode of said third diode.

6. The electrical circuit as recited in claim 1, further comprising an electrical plug in electrical connection with said plural groups.

7. The electrical circuit as recited in claim 6, wherein said electrical plug has means for rectifying an AC input to a DC output.

8. An electrical circuit for use as a string of lights, said circuit comprising:

plural groups of electrical loads, each group of said plural groups arranged electrically in series with each other group of said plural groups, each load within said each group being arranged electrically in parallel with each other load within said each group; and plural sets of semiconductors arranged in parallel to said each group of said plural groups, said sets of semiconductors programmed to limit electrical current and voltage in said plural groups in the event a load from said group is dropped.

9. The electrical circuit as recited in claim 8, wherein said limiting means comprises a first diode, a second diode and a Zener diode, said first, second and Zener diodes each having an anode and cathode, said anode of said Zener diode being connected electrically in series with said cathode of said first diode, said cathode of said Zener diode being connected electrically in series with said anode of said second diode.

10. The electrical circuit as recited in claim 8, wherein said limiting means comprises a first diode, a second diode, third diode, a fourth diode, a first Zener diode and a second Zener diode, said first, second, third, fourth, first Zener and second Zener each having an anode and cathode, said anode of said first Zener diode being connected electrically in series with said cathode of said first diode, said cathode of said first Zener diode being connected electrically in series with said anode of said second diode, said anode of said second Zener diode being connected electrically in series with said cathode of said third diode, said cathode of said second Zener diode being connected electrically in series with said anode of said fourth diode, said cathode of said fourth diode being connected electrically to said anode of said first diode, said cathode of said second diode electrically connected to said anode of said third diode.

11. The electrical circuit as recited in claim 8, further comprising an electrical plug in electrical connection with said plural groups.

12. The electrical circuit as recited in claim 8, wherein said electrical plug has means for rectifying an AC input to a DC output.

13. The electrical circuit as recited in claim 8, wherein each group of said plural groups has five electrical loads.

14. The electrical circuit as recited in claim 8, wherein said electrical loads are light bulbs.

15. An electrical circuit for use as a string of lights, said string of lights comprising:

plural groups of light bulbs, each group of said plural groups of light bulbs arranged electrically in series, each light bulb of said each group of light bulbs arranged electrically in parallel with each other light bulb in said each group of light bulbs;

plural sets of semiconductors arranged parallel to said each group of said plural groups, said plural sets of semiconductors programmed to limit electrical current and voltage in said plural groups in the event an individual load from said group is dropped; and an electrical plug in electrical connection with said plural groups, said electrical plug formed to fit into a wall outlet socket.

16. The electrical circuit as recited in claim 15, wherein each set of said sets of semiconductors comprises a first diode, a second diode and a Zener diode, said first, second and Zener diodes each having an anode and cathode, said anode of said Zener diode being connected electrically in series with said cathode of said first diode, said cathode of said Zener diode being connected electrically in series with said anode of said second diode.

17. The electrical circuit as recited in claim 15, wherein said limiting means comprises a first diode, a second diode, third diode, a fourth diode, a first Zener diode and a second Zener diode, said first, second, third, fourth, first Zener and second Zener each having an anode and cathode, said anode of said first Zener diode being connected electrically in series with said cathode of said first diode, said cathode of said first Zener diode being connected electrically in series with said anode of said second diode, said anode of said second Zener diode being connected electrically in series with said cathode of said third diode, said cathode of said second Zener diode being connected electrically in series with said anode of said fourth diode, said cathode of said fourth diode being connected electrically to said anode of said first diode, said cathode of said second diode electrically connected to said anode of said third diode.

18. The electrical circuit as recited in claim 15, wherein said electrical plug has means for rectifying an AC input to a DC output.

19. The electrical circuit as recited in claim 15, wherein each group of said plural groups includes 5 light bulbs.

* * * * *